US007337484B2

(12) United States Patent
Cox

(10) Patent No.: US 7,337,484 B2
(45) Date of Patent: Mar. 4, 2008

(54) DISPOSABLE BODY BOARD

(75) Inventor: Gary L. Cox, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 121 days.

(21) Appl. No.: 11/105,634

(22) Filed: Apr. 14, 2005

(65) Prior Publication Data

US 2006/0230535 A1 Oct. 19, 2006

(51) Int. Cl.
*A61G 1/00* (2006.01)

(52) U.S. Cl. ..... 5/625; 5/627; 128/870

(58) Field of Classification Search ..... 5/625–629; 108/53.1

See application file for complete search history.

(56) References Cited

U.S. PATENT DOCUMENTS 3,151,343 A * 10/1964 McCormick ..... 5/627
4,139,918 A * 2/1979 Covington ..... 5/186.1
4,209,011 A * 6/1980 Peck et al. ..... 602/19
6,094,761 A * 8/2000 Ferko, III ..... 5/625
6,227,201 B1 * 5/2001 Ferko, III ..... 128/869

* cited by examiner

*Primary Examiner*—Michael Trettel
(74) *Attorney, Agent, or Firm*—Maginot, Moore & Beck

(57) ABSTRACT

An assemblable body board is formed from a blank made from a sheet of a bendable or foldable material, such as fiberboard. The blank includes a center panel, opposite side panels and opposite end panels, wherein the side and end panels are foldable to form a rectangular construct at the bottom face of the center panel. Each side and end panel includes a reinforcement beam, with each beam including holes at its opposite end for receiving a cable tie. A cable tie is provided at each corner so that when the cable ties are tightened the side and end panels converge to form a corner of the body board. A pair of cable ties also span the width of the center panel and maintain the side panels in their perpendicular orientation when the body board is assembled. The side panels define hand-hold cut-outs and flaps that allow medical personnel to grasp the body board, bearing against the side reinforcement beams.

49 Claims, 4 Drawing Sheets

DISPOSABLE BODY BOARD

BACKGROUND OF THE INVENTION

The present relates to body boards for use in transporting a patient. More specifically, the invention is directed to an easy-to-assembly disposable body board.

Body boards are essential equipment for emergency medical personnel or technician (EMT) to safely move a patient from one location to another. The body board allows patient transport while minimizing the risk of aggravating existing injuries. The body board is particularly used where a spinal injury is suspected. In some cases, a head restraint is affixed to the body board to completely restrain the patient's head. Standard stretchers are not suitable for this type of patient transport since stretchers lack the ability to completely immobilize the patient.

The typical body board is in the form of a rigid metal, plastic or wood board with handles or hand-holds for gripping the board. The board also includes an array of openings along the side of the board for passage of patient restraint devices, such as straps or belts. The boards are sufficiently rigid to support the weight of the patient without bending or buckling. Modern body boards are also sufficiently lightweight to avoid adding unnecessary weight that must be carried by the medical personnel. The light weight also minimizes the weight of the equipment payload the must be carried on the emergency vehicle.

In use, the body board is stowed in the emergency vehicle and removed at the location of the patient. The medical personnel are highly trained in positioning the patient on the body board without disturbing the neck and spine. Once the patient is on the board and restrained with the straps, the board is used to carry the patient to the emergency vehicle for transport to the hospital or trauma center. In some cases, the body board may be supported on a conventional stretcher to help carry the patient.

At the hospital, the patient usually remains on the body board while a diagnosis is made of the extent of the injuries, and the injury, if any, to the neck or spine. Frequently, the patient remains on the body board while diagnostic tests are conducted, such as x-rays or CT scans, to determine whether a spinal injury has occurred. Depending upon the nature of the injury, the patient may remain on the body board during initial treatment to stabilize the injury.

The typical body board is intended for re-use. However, unless the patient is immediately removed from the body board, the emergency medical personnel must leave the body board behind when they return to their emergency vehicle. Once the patient has been transferred from the body board, the board can be returned to the emergency personnel. Usually, the body board is stored until the EMT returns, usually with another patient. This protocol usually dictates that more than one body board be available with every emergency vehicle. The problem is exacerbated for vehicles equipped to handle multiple patients requiring body board immobilization.

In order to address this problem, back boards have been developed made of inexpensive materials that may be stored flat and then assembled on site into a sturdy support for the patient. An example of a disposable backboard is found in U.S. Pat. No. 4,584,729 to Roberts et al. This patent discloses a backboard formed of a multiple ply corrugated material with side wings that folded upward from an initially nearly flat configuration. The side wings included cut-outs for handholds.

A need still exists for a disposable body board or backboard that meets at least the following criteria: a) lightweight; b) capable of supporting heavy patients, on the order of 300 pounds; c) able to be stored flat until needed for use; d) quickly and easily assembled at the site of the patient; e) quickly and easily broken down for disposal or recycling; and f) easily and inexpensively manufactured.

SUMMARY OF THE INVENTION

These criteria are met by the body board of the present invention. In one preferred embodiment, the body board is formed from a flat blank or lightweight but strong material. The material may be single wall corrugated fiberboard that can be easily die cut from a rectangular blank.

In accordance with the preferred embodiment of the invention, a blank of a foldable sheet material is provided that may be formed into a body board suitable for carrying a patient. IN accordance with the preferred embodiment, the blank comprises an elongated center panel sized to support a patient thereon and opposite side panels attached to the center panel along corresponding longitudinal joints. Each of the side panels includes an outer side panel contiguous with a corresponding longitudinal joint, and a side reinforcement panel attached to the outer side panel along a longitudinally extending apex bend line and having a free edge. In an unassembled configuration, the blank is essentially flat. The blank is configured so that the opposite side panels are foldable along the longitudinal joints and apex bend lines so that the outer side panels are disposed at a substantially perpendicular angle relative to the center panel, and the side reinforcement panels are inboard of the outer side panels with the free edges adjacent the center panel.

In one aspect of the invention, each of the opposite side panels defines at least one opening configured to receive a tension element therethrough. In the preferred embodiment, the tension element is a cable tie. The cable tie is initially loosely fastened together between the opposite side panels. When the body board is assembled, the cable tie is tightened, drawing and holding the side panels in the perpendicular orientation. In the preferred embodiment, two cable ties are spaced apart generally mid-length along the blank.

The blank also comprises opposite end panels attached to the center panel along corresponding end joints. Each of the end panels includes an outer end panel contiguous with a corresponding end joint, and an end reinforcement panel attached to the outer end panel along an apex bend line and having a free edge. Like the side panels, the opposite end panels are foldable along the end joints and apex bend lines so that the outer end panels are disposed at a substantially perpendicular angle relative to the center panel, and the end reinforcement panels are inboard of the outer end panels with the free edges adjacent the center panel.

The side and end panels include contoured edges that are complementary to form a corner joint when the side and end panels are folded to their perpendicular configuration. One feature of the invention contemplates a tension element that is operable to fix the corner joints, or connect the side and end panels at the corners to form the rectangular construct on the bottom face of the center panel. Thus, in accordance with this feature, the tension element includes a cable tie that connects adjacent ends of the side and end panels. Preferably, the side and end panels include reinforcement beams passing through the panels. The cable ties pass through openings at the end of the reinforcement beams so that when the cable ties are tightened the beams are drawn together to form the body board corners.

In yet another feature of the preferred embodiment, each of the opposite side panels defines a plurality of hand-hold cut-outs sized to receive a human hand for grasping. The plurality of hand-hold cut-outs straddle the apex bend line, whereby when the side panels are folded at the apex bend line the cut-outs form an opening along the apex bend line. Preferably, the opposite side panels also define a hand-hold flap within each of the plurality of hand-hold cut-outs. The flap is arranged to be folded over the reinforcement beam beneath the hand-hold cut-outs. With this feature, the hand-holds are at the edge of the side panels, rather than enclosed openings through the body of the panels. Moreover, with this feature, the reinforcement beams carry the bulk of the load when the assembled body board is lifted while carrying a patient.

In the preferred embodiment, the body board is disposable or recyclable, and is preferably intended for a single use. Thus, in accordance with one embodiment of the invention, the blank is formed of a cellulosic material, such as a fiberboard. In a specific embodiment, the fiberboard is a single wall corrugated fiberboard. The blank may further include a substantially rectangular support board affixed to the blank within the center panel. This support board is preferably formed of a double-walled corrugated fiberboard.

In keeping with the single use approach, the reinforcement beams are also preferably formed of a cellulosic material, such as a double wall corrugated medium density fiberboard. The beams may also be formed of a light weight wood, such as pine or plywood.

Preferably, the reinforcement beams are permanently attached to the blank. In one embodiment, the side and end reinforcement beams are adhered or glued to the blank. Staples are preferably used to hold the beams to the panels of the blank during shipment and in final assembly. In some cases, the staples may be used temporarily until the beams are adhered to the panels.

According to one embodiment of the invention, an assemblable body board comprises a blank formed of a sheet of a foldable material, wherein the blank includes: a generally rectangular center panel sized to support a patient thereon and having longitudinal side edges, transverse end edges and corners therebetween and opposite side panels attached to the center panel along the side edges and foldable at the side edges to a position substantially perpendicular to the center panel. Each of the side panels includes an outer side panel contiguous with a corresponding side edge and a side reinforcement panel attached to the outer side panel along a longitudinally extending apex bend line and having a free edge, the side reinforcement panel foldable along the apex bend line so that the side reinforcement panel is inboard of the outer side panel and the free edge is adjacent the center panel.

The blank further includes opposite end panels attached to the center panel along the end edges and foldable at the edges to a position substantially perpendicular to the center panel. The assemblable body board further comprises a pair of side reinforcement beams that are substantially more rigid than the blank. A corresponding one of the pair of beams is affixed to each of the opposite side panels to be disposed between the outer side panel and the side reinforcement panel when the side reinforcement panel is folded. Preferably, each of the side reinforcement beams is adhered to the side reinforcement panel of each of the opposite side panels. The assemblable body board may also comprise a pair of end reinforcement beams that are substantially more rigid than the blank, with a corresponding one of the end reinforcement beams affixed to each of the end panels to be disposed between the outer end panel and the end reinforcement panel when the end reinforcement panel is folded.

According to one aspect of this embodiment, each of the side and end reinforcement beams defines an opening at the ends thereof, and the body board further comprises a plurality of cable ties. At least one of the cable ties passes through the opening in a side reinforcement beam and the opening in an end reinforcement beam, initially loosely spanning between the side and end reinforcement beams across a corner of the body board so that the side and end panels may lie generally flat. The plurality of cable ties are configured to be pulled into tension to connect the side and end reinforcement beams at the corners.

It is one object of the invention to provide a disposable body board for use in immobilizing and transporting patients, especially those who might have suffered a neck or spinal injury. Another object accomplished by the invention is to provide a body board that can be stored flat so that several such un-assembled boards can be easily stowed in an emergency vehicle.

One benefit of the disposable body board of the present invention is that it can be quickly assembled with minimal effort at the site of the patient. Similarly, a further benefit is that the assembled board can be equally quickly broken down for disposal or recycling.

Other objects and benefits of the invention will become apparent upon consideration of the following written description taken together with the accompanying figures.

DESCRIPTION OF THE PREFERRED EMBODIMENTS

Figure 1:
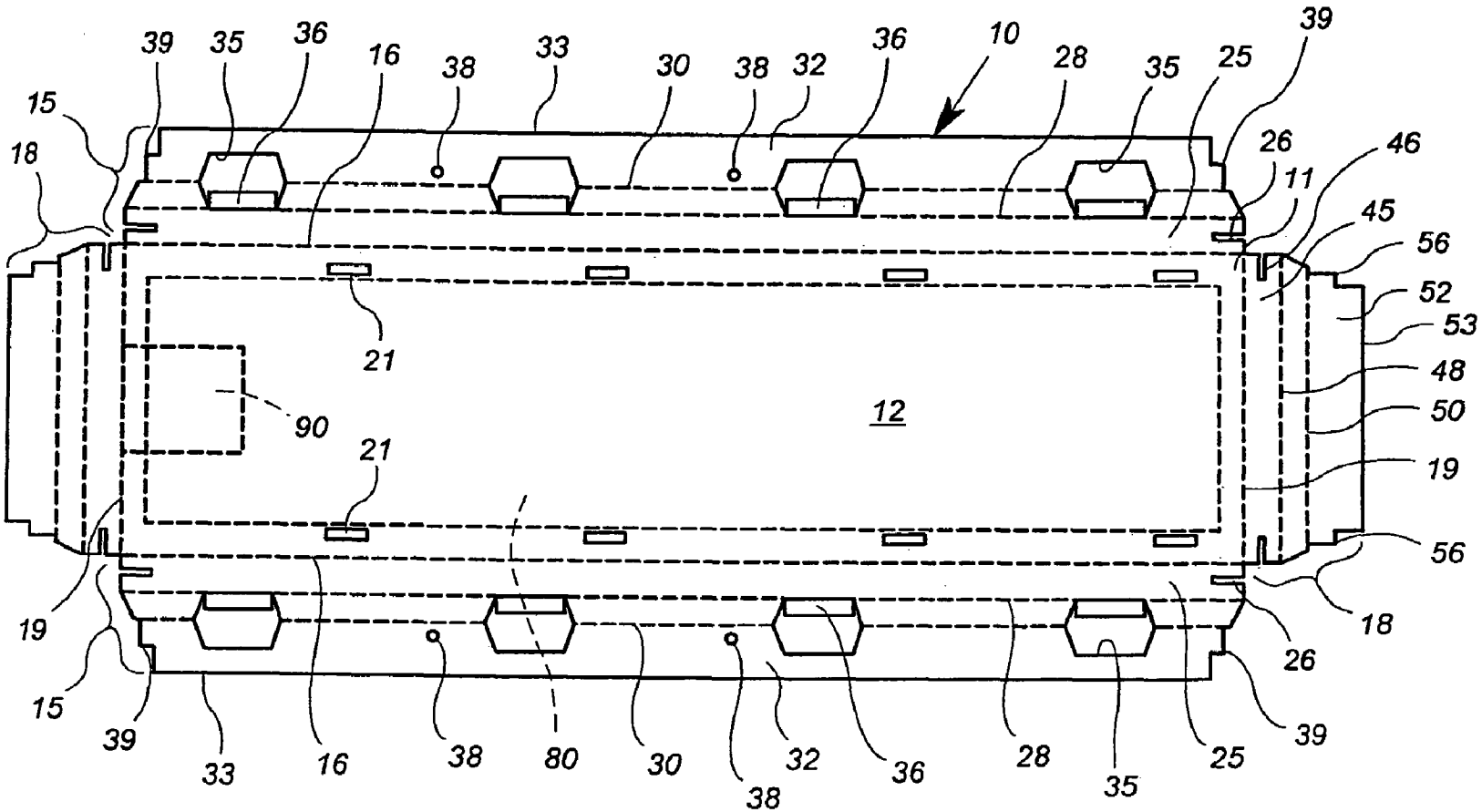
FIG. 1 is a plan view of the bottom face of a blank that can be assembled into a body board in accordance with one embodiment of the invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The present invention provides an assemblable body board that is formed from a sheet of bendable material that is preferably die cut into a blank, such as the blank 10 shown in FIG. 1. The blank is configured to be quickly and easily assembled or folded into a strong body board capable of supporting a patient. In the preferred embodiment, the blank is formed of a sheet of a cellulosic material, such as fiberboard, that may be corrugated for additional strength. The blank 10 is preferably pre-treated in a conventional manner, such as with a waterproof coating.

As depicted in FIG. 1, the blank includes inner and outer features that can be readily formed in a single die cut or stamping operation. Thus, in the preferred embodiment, the blank 10 includes a center panel 11 that is rectangular in configuration and is sized to provide ample surface for supporting a patient. In a specific example, the center panel 11 is at least about 70 inches long and about 20 inches wide to accommodate a typical adult patient. Smaller dimensions may be used for pediatric patients. As explained in more detail herein, a reinforcement panel 80 is mounted to the bottom surface 12, as depicted in dashed lines in FIG. 1. The panel 80 is sized to fit between strap openings 21 defined in the center panel 11. The strap openings are disposed in pairs on opposite sides of the panel and are configured to receive standard patient restraint straps or belts. As shown in FIG. 1, the straps are evenly distributed along the panel but are shifted away from the head end of the blank, as designated by the dashed region 90.

The blank 10 includes opposite side panels 15 that are attached to or integral with the center panel along a longitudinal joints 16 corresponding to the longitudinal side edges of the center panel. Similarly, opposite end panels 18 are attached to or integral with the center panel at end joints 19 corresponding to the transverse end edges of the center panel 11.

The longitudinal joints 16 represent bend lines where the side panels 15 are ultimately bent substantially perpendicular to the center panel 11 when the body board is constructed or assembled. The side panels themselves include bend lines where the side panels are folded to form a reinforced side wall construction. Thus, each side panel 15 includes an outer side panel 25 that is exposed outward when the side panels are folded to construct the body board. The outer side panel 25 is bounded on one edge by the longitudinal joint 16 and on its opposite side edge by an apex bend line 30. An intermediate bend line 28 may be formed in the outer side panel between the longitudinal joint and the apex bend line. It is understood that these bend lines may be formed in a conventional manner to facilitate folding or bending of the blank 10 along the particular line. In the most preferred embodiment, the longitudinal joint 16, apex bend line 30 and intermediate bend line 28 are created by forming a crease in the blank, configured so that the blank preferentially bends along the crease when the side panel 15 is moved out of the plane of the center panel 11.

The side panels 15 further include a side reinforcement panel 32 that is attached along one side edge to the outer side panel 25 at the apex bend line 30. The other side edge of each reinforcement panel 32 constitutes a free edge 33.

A similar construction is followed for the end panels 18. Thus, the end panels include an outer end panel 45 attached to the transverse end edge of the center panel 11 along end joints 19. The outer end panel includes an intermediate bend line 48 and an apex bend line 50 at the end extreme of the outer end panel 45. An end reinforcement panel 52 is attached to the outer end panel 45 along the apex bend line 50. The end reinforcement panels 52 include end free edges 53.

The opposite ends of the outer side panel 25 define edge notches 26 that are preferably open at the end edge of the outer panel. Similarly, the opposite ends of the outer end panels 45 define edge notches 46 that are arranged to coincide with the notches 26 of the side panels when all of the panels are folded to their perpendicular orientations. In that regard, the side panels 15 and end panels 18 include corresponding complementary corner edges 39, 56, respectively. These edges 39, 56 are configured to generally fit together when the side and end panels are in their assembled configuration to form a corner 74 of the assembled body board, as best shown in enlarged view of FIG. 6.

Returning to the description of the side panels 15, a series of hand-hold cut-outs 35 are formed in the panels. Preferably, the cut-outs 35 overlap the outer side panel 25 and side reinforcement panel 32 and straddle the apex bend line 30. Most preferably, the cut-outs are symmetric about the apex bend line so that the opposite halves of the cut-outs 35 match when the side reinforcement panel is folded about the apex bend line. The outer side panel 25 further includes a hand-hold flap 36 that is situated within each cut-out 35. The hand-hold features are spaced along the longitudinal extent of each side panel 15 as is known in the art. Preferably, the hand-hold features 35, 36 provide a hand-hold immediately adjacent the head end 90 of the body board, with three additional hand-holds spaced evenly along the length. A similar hand-hold cut-out and flap construction may be incorporated into the end panels 18.

The side panels also include a feature for connection of a tension member spanning across the bottom face 12 of the blank when the body board is assembled. Thus, in one embodiment, the side reinforcement panels define a pair of offset holes 38. In a specific embodiment, the holes 38 are sized to receive a cable tie, such as the cable ties 77 shown in FIG. 4.

Figure 3:
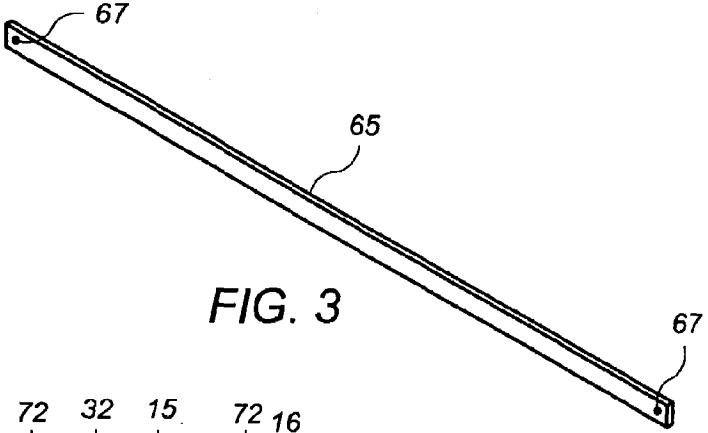
FIG. 3 is a perspective view of a side reinforcement strip for use with the blank shown in FIG. 1 to form the body board.
Figure 2:
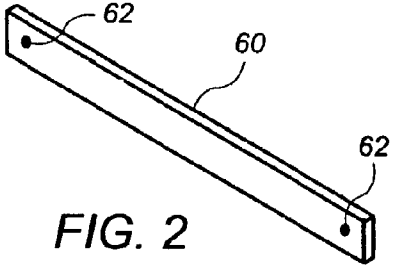
FIG. 2 is a perspective view of an end reinforcement strip for use with the blank shown in FIG. 1 to form the body board.

In one feature of the invention, the bendable or foldable blank 10 is augmented by a pair of reinforcement beams. In particular, a pair of end reinforcement beams 60 are provided that are sized to fit within the end panels 18, as shown in FIG. 2. A pair of side reinforcement beams 65, shown in FIG. 3, are also provided that are sized to fit within the side panels 15. The beams 60, 65 are formed to be substantially more rigid than the bendable blank 10. The beams may be formed of medium density fiberboard, or a lightweight wood such as pine or plywood. The beams 60, 65 provide rigidity to the body board when the blank is folded to the configuration shown in FIGS. 5, 6.

Figure 4:
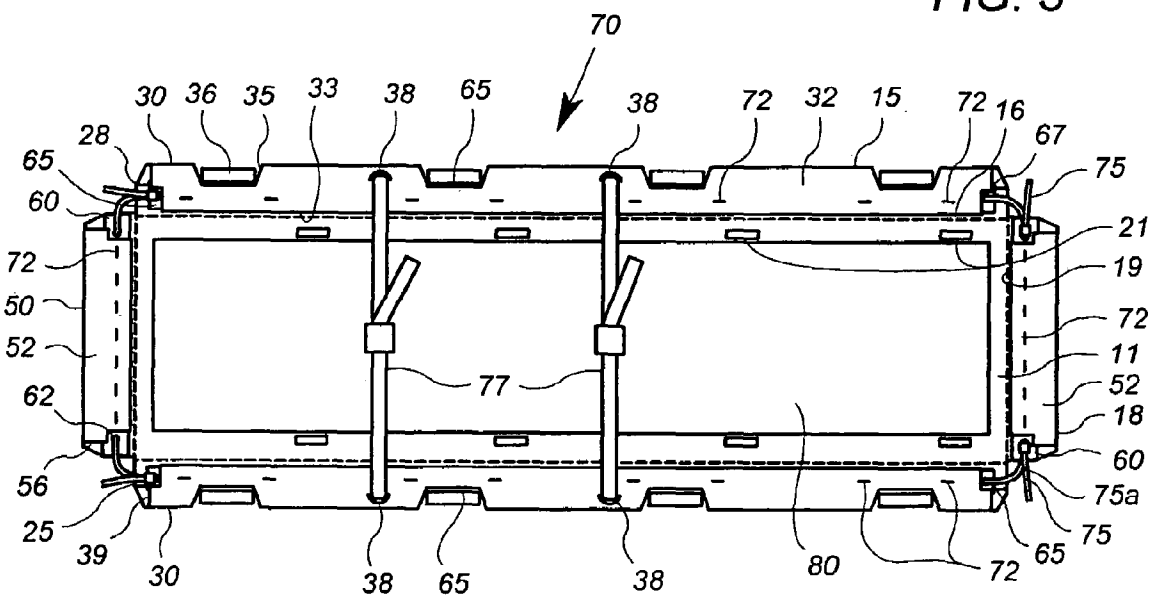
FIG. 4 is a bottom elevational view of the blank and reinforcement strips shown in FIGS. 1-3 partially assembled to form the body board of the present invention.
Figure 5:
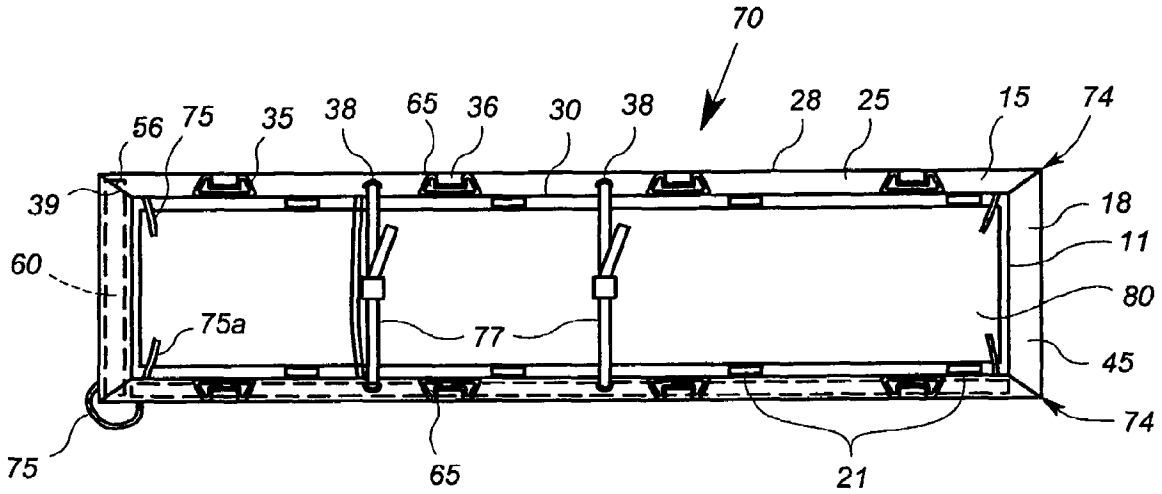
FIG. 5 is a bottom elevational view of an assembled body board according to one embodiment of the present invention.
Figure 7:
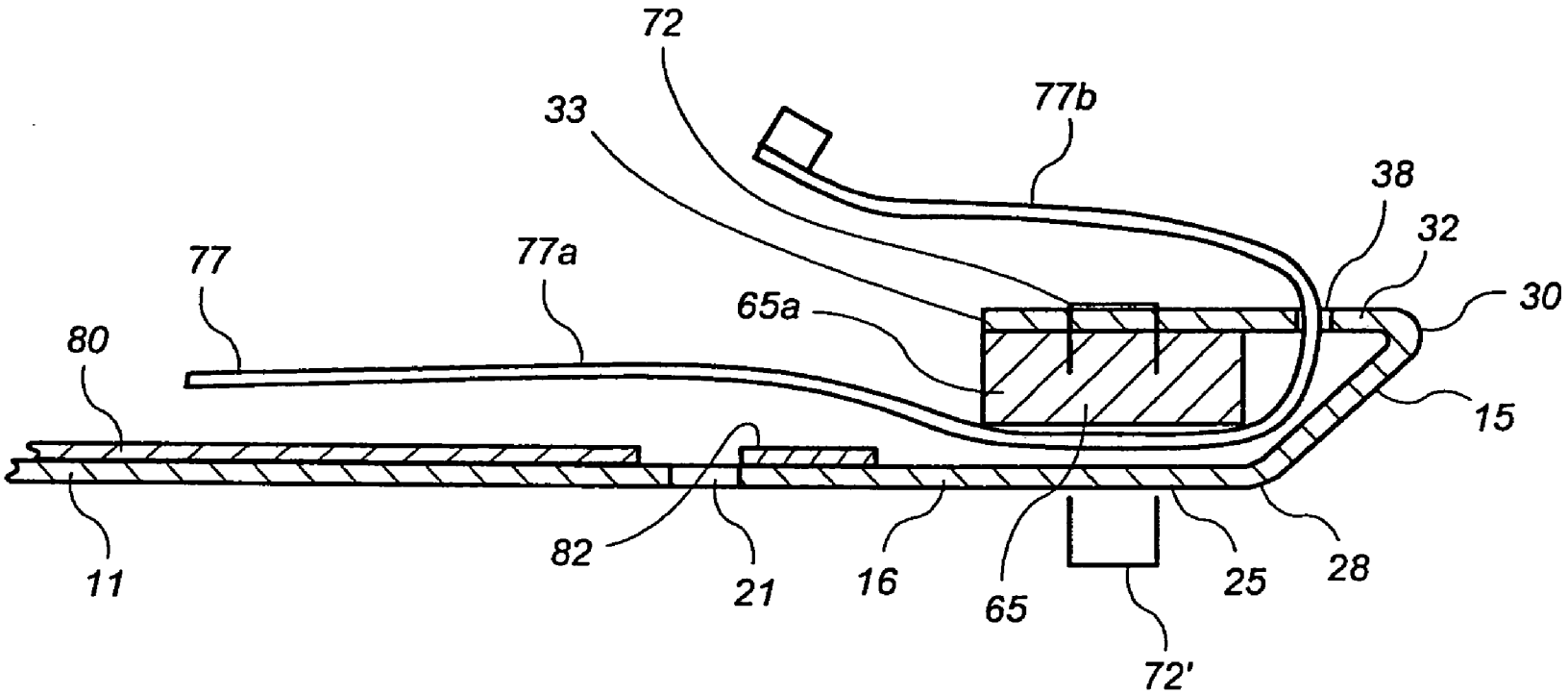
FIG. 7 is an enlarged partial cross-section view of the blank and reinforcement strips in the partially assembled condition illustrated in FIG. 4.

As shown in FIG. 4, the side reinforcement beams are integrated into the side panels 15, while the end beams 60 are integrated into the end panels 18. As shown in the enlarged cross-sectional view of FIG. 7, the beams 65 are preferably connected to the reinforcement panels 32. Preferably, the beams are substantially permanently affixed, such as by the use of glue, epoxy or a similar agent capable of bonding the materials of the blank 10 and beams 65. The beams 60 are similarly affixed to the end reinforcement panels 52. In certain embodiments, the attachment of the beams to the panels is augmented by a series of staples 72. The staples may be used to hold the beams to the panels only until the components are fully bonded, after which the staples are removed. However, in the most preferred embodiment, the staples are retained in the assembled body board 70, as shown in FIGS. 4-5. The body board is shown in FIG. 7 in its shipping configuration—i.e., in which the side panels 15 are generally planar with the center panel 11. When the body board is assembled and the side panels are folded upward, additional staples 72' may be inserted through the outer side panel 25 and into the reinforcement beam 65, as illustrated in FIG. 7.

Figure 6:
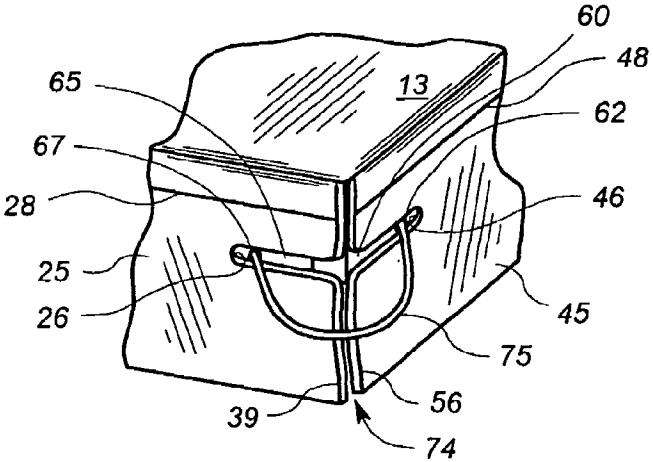
FIG. 6 is an enlarged perspective view of one corner of the assembled body board depicted in FIG. 6.

The beams include holes at their opposite ends. Thus, the end beams 60 include holes 62 and the side beams include holes 67. These holes are arranged to align with the end notches 46, 26, respectively when the beams are affixed to the corresponding outer panel, as best shown in FIG. 6.

In FIG. 4, the body board 70 is shown in its initial knocked-down or unassembled configuration. The board is suitable for storage in this configuration since it is substantially flat. In this configuration, the reinforcement beams 60, 65 have been affixed to the side and end panels. The end beams 60 are affixed to the outer end panel 45 with the holes 62 aligned with the end notches 46. Likewise, the side beams 65 are affixed to the outer side panel 25 with the holes 67 aligned with the end notches 26. It can be appreciated that the beams span the respective length and width of the side and end panels. Moreover, the beams have a width that is slightly less than the width between the longitudinal joint 16 and intermediate bend line 28 so that the beams preferably do not intrude significantly into the hand-hold cut-outs 35 when affixed to the side panels.

The body board 70 also includes a support board 80 that is affixed to the bottom surface 12 of the center panel 11. The support board 80 provides reinforcement at the load-bearing portion of the body board. The board may be affixed to the panel 11 in a manner similar to that used to affix the reinforcement beams—i.e., with glue, adhesive or other suitable bonding agent. Staples may be used to temporarily hold the support board 80 to the panel, however, it is preferable that these staples be removed before the body board is used since the staples would interrupt the upper surface 13 (FIG. 6) of the body board on which the patient is placed.

The support board is formed of a light weight but strong material and is substantially more rigid than the bendable panels of the blank 10. In a preferred embodiment, the board 80 is formed of a fiberboard, and most preferably a laminated double-walled corrugated fiberboard. Optionally, the support board may be composed of wood, such as pine or plywood.

In the flat configuration shown in FIG. 4, the reinforcement panels 32 and 52 are folded along their respective apex bend lines 30, 50 so that the panels 32, 52 and the reinforcement beams 65, 60 overlap the outer panels 25, 45. This overlapping relationship is shown in FIG. 7 with respect to the side panel 15. As seen in FIG. 7, the side panel 15 is folded back on itself at the apex bend 30. At the intermediate bend line 28, the panel is bent only slightly so that the reinforcement beam 65 can lay generally flat against the inside of the outer side panel 25. Similar bends are made at the bend lines 48 and 50 of the end panels 18.

In one feature of the body board 70, transverse tension members 77 span between the side panels 15, as shown in FIG. 4. More specifically, the members 77 pass through the holes 38 formed in the side reinforcement panels 32. In the preferred embodiment, the members 77 pass through the holes 38 and around the reinforcement beams 65. It can be appreciated that the tension members 77 will have a lower portion 77*a* passing underneath one beam 65, resting against the support board 80 and then passing underneath the beam of the opposite side panel. The tension members also include an upper portion 77*b* that exits from the hole 38 in one side panel, traverses the width of the body board, and re-enters the hole 38 of the opposite side panel.

In the stowed configuration shown in FIG. 4, the tension members 77 are loosely connected between the side panels. In the preferred embodiment, the members 77 are in the form of cable ties that can be tightened at a later time when it is necessary to assemble the body board. The ends of the cable ties are loosely connected in the configuration shown in FIG. 4 so that the members 77 do not pull the side panels 15 together. When it is desired to assemble the body board 70, the tension members 77 are tightened, or drawn into tension, which pulls the opposite side panels together, as shown in FIG. 5. Alternatively, the side panels may be folded along the longitudinal joint 16 and then the tension members 77 tightened. Of course, it is important that the end panels 18 are also folded into their perpendicular position so that the side and end panels meet at the corners 74 of the body board 70. The tension members 77 then operate to hold the construct together and prevent splaying of the side panels 15 when the center panel 11 and reinforcement board 80 are under load.

Returning to FIG. 4, the corners of the body board 70 are provided with corner tension members 75 that may be cable ties like the tension members 77. The corner tension members 75 pass through opening 62 in end reinforcement beam 60 and opening 67 in side reinforcement beam 65 to couple the end and side beams at the corners 74. As shown in FIG. 4, the tension members 75 are initially loosely engaged so that the end and side panels may lie substantially flat when the body board is in its partially assembled, stored configuration. Preferably, the head 75*a* of the tension element or cable tie is disposed adjacent the bottom face 12 of the center panel 11 so that the head 75*a* is within the interior space formed when the end and side panels are folded perpendicular. With this arrangement, the head and tail of the cable tie is not exposed on the outside of the assembled body board 70.

When the body board 70 is assembled, the corner tension members 75 are tightened to draw the side edges 39 and 56 together. When the edges are drawn together, the reinforcement beams 60 and 65 abut, as shown in FIG. 6 so that the beams 60, 65 and panels 15, 18 cooperate to form a rigid rectangular construct underneath the center panel 11. This rectangular construct resists bending or buckling of the center panel when a patient is being carried on the body board 70. The tightened tension members 77 positioned in the middle portion of the board also resists buckling of the side panels 15 under load.

The tension members 65, 67 and the reinforcement beams 60, 65 combine to form a very sturdy body board that is capable of supporting the weight of a typical patient. In a specific embodiment, the reinforcement beams 60, 65 are 0.5 inches thick and about 2.0 inches wide and are formed of a medium density fiberboard, but may be of other similar strength material. The blank 10 is formed of 0.2 inch thick single wall corrugated fiberboard, such as 55 ECT single wall Kraft board.

When assembled, the side panels and end panels extend about 2.5 inches below the bottom face 12 of the center panel. The support board 80 is formed of about 0.3 inch thick double wall corrugated fiberboard, such as 71 ECT double wall Kraft board. The tension members 75 and 77 in the specific embodiment are standard ¼ inch cable ties that are hand tightened as far as possible. Since the cable ties include some portion passing through or around one of the reinforcement beams it is not necessary of the blank 10 itself support the tightened tension members. When assembled, as shown in FIG. 5, the resulting body board 70 is capable of supporting a patient weighing over 300 lbs. In the specific embodiment, the body board may support up to about 520 lbs.

When the body board is assembled, the hand-hold cut-outs 35 provide clear access to the hand-hold flaps 36. The cut-outs 35 fold over along the apex bend line 30 so that the cut-out openings are along the bottom edge of the folded side panels. Thus, there is no need for the EMT to insert his/her hands into an enclosed opening, as with prior disposable back boards. When the body board 70 is assembled, the flaps bear against the bottom edge of the side reinforcement beams when grasped. The flaps 36 provide an adequate surface for manually gripping and protect the medical personnel's hands from the relatively rougher edges of the underlying reinforcement beam. At the same time, the beams 65 themselves bear the load since the EMT will be essentially gripping the side reinforcement beam to carry the body board 70, albeit with the hand-hold flaps 36 intervening.

In one modification of the preferred embodiment, a reinforcement strip 82 may be positioned on opposite sides of the center panel 11 outboard of the support board 80 and the strap cut-outs 21, as shown in FIG. 7. These reinforcement strips are positioned so that the top edge 65*a* of each side reinforcement beam 65 bears against a corresponding strip 82 when the side panel is in its final assembled configuration (FIG. 5). When the tensioning members 77 are tightened, the side panels 15 fold along the longitudinal joint 16. In the folded position, the top edge 65*a* of each beam 65 is immediately adjacent the center panel 11. When the body board 70 is under load—i.e., when a patient is lifted on the board—the beams 65 move into contact with the center panel. The reinforcement strips 82 provide additional material at that line of contact to eliminate the risk of the reinforcement beam wearing or tearing through the center panel, especially when the patient is transported over a long distance.

It can be appreciated that the body board 70 of the present invention may be easily stored in its unassembled configuration depicted in FIG. 4. The overall thickness of the unassembled board is only about 1.0 inches, so several unassembled boards may be stacked or stowed vertically in the emergency vehicle. In addition, once the board has been used and is ready to discard, the board may be easily disassembled by severing and removing the tension elements 75, 77, reducing the board to a flat panel. Since the body board 70 is formed of inexpensive materials, a board may be discarded or recycled after a single use. There is no need to clean and sterilize the board 70. Moreover, there is no need for the board to be returned to the EMT that brought the particular patient to the treatment facility.

In the unassembled configuration of FIG. 4, the side and end panels 15, 18 are ready to be folded into their perpendicular orientations and the tension members 75, 77 are ready to be tightened. In the preferred embodiment, the body board may be assembled by tightening the six cable ties, a process which takes only a few seconds and can be easily performed by one person. The free ends of the cable ties are all disposed beneath the support surface so that the cable ties will not snag when the board is being used. Moreover, the portion of the corner cable ties 75 that extends on the outside of the reinforcement beams is recessed within the end notches 26, 46, as shown in FIG. 6, so the tightened cable ties cannot be snagged at the corners 74 of the body board.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

For example, in the preferred embodiment, the corner tension elements 75 individual cable ties at each corner. In an alternative embodiment, a single tension element may span the entire perimeter of the body board, akin to a drawstring. The tension element in this alternative embodiment would pass through the holes 62, 67 at the ends of the reinforcement beams 60, 65 and would pass behind the beams from one end to the other. This alternative tension element would be tightened at one corner only.

As a further alternative, the tension elements 75, 77 may have different configurations than the cable tie of the preferred embodiment. However, in order to preserve the ability to easily store the unassembled body board, the alternative tension elements must have a relaxed configuration that permits the board to be opened flat, and must be quickly and easily placed in tension when the body board is assembled.

The features of the present invention are especially useful for a fully disposable or recyclable body board. In the most preferred embodiment, the body board blank 10 is formed of a fiberboard material. Alternatively, the blank may be stamped or die cut from another bendable and lightweight material, such as a plastic. With a plastic embodiment, the bend lines 28, 30, 48 and 50 are optimally formed as score lines in a thin plastic sheet.

What is claimed is:

1. A blank of a foldable sheet material for forming a body board suitable for carrying a patient, the blank comprising:

an elongated center panel sized to support a patient thereon;

opposite side panels attached to said center panel along corresponding longitudinal joints, each of said side panels including;

an outer side panel contiguous with a corresponding longitudinal joint; and a side reinforcement panel attached to said outer side panel along a longitudinally extending apex bend line and having a free edge, wherein the opposite side panels are foldable along said longitudinal joints and apex bend lines so that said outer side panels are disposed at a substantially perpendicular angle relative to said center panel, and said side reinforcement panels are inboard of said outer side panels with said free edges adjacent said center panel, and further wherein each of said opposite side panels defines at least one opening configured to receive a tension element therethrough; and opposite end panels attached to said center panel along corresponding end joints, each of said end panels including;

an outer end panel contiguous with a corresponding end joint; and an end reinforcement panel attached to said outer end panel along an apex bend line and having a free edge, wherein the opposite end panels are foldable along said end joints and apex bend lines so that said outer end panels are disposed at a substantially perpendicular angle relative to said center panel, and said end reinforcement panels are inboard of said outer end panels with said free edges adjacent said center panel.

2. The blank of claim 1, wherein each of said opposite side panels define a plurality of hand-hold cut-outs sized to receive a human hand for grasping.

3. The blank of claim 2, wherein said plurality of hand-hold cut-outs straddle said apex bend line, whereby when said side panels are folded at said apex bend line said cut-outs form an opening along said apex bend line.

4. The blank of claim 2, wherein said opposite side panels define a hand-hold flap within each of said plurality of hand-hold cut-outs.

5. The blank of claim 1, wherein said center panel defines a plurality of strap cut-outs adjacent each of said longitudinal joints, said strap cut-outs sized to receive a patient restraint therethrough.

6. The blank of claim 1, wherein said side panels include side panel edges at the opposite longitudinal ends thereof, and said end panels include end panel edges at the opposite transverse ends thereof, said side panel edges and end panel edges being complementary to form a corner when said side panels and said end panels are folded to the substantially perpendicular angle.

7. The blank of claim 1, wherein said blank is formed of a cellulosic material.

8. The blank of claim 7, wherein the cellulosic material is a fiberboard.

9. The blank of claim 8, wherein the fiberboard is a single wall corrugated fiberboard.

10. The blank of claim 1, further comprising a substantially rectangular support board affixed to said blank within said center panel.

11. The blank of claim 10, wherein said support board is formed of a double-walled corrugated fiberboard.

12. An assemblable body board formed from a foldable blank comprising:

a generally rectangular center panel of the foldable blank sized to support a patient thereon and having longitudinal side edges, transverse end edges and corners therebetween;

opposite side panels of the foldable blank attached to said center panel along said side edges and folded at said side edges to a position substantially perpendicular to said center panel;

opposite end panels of the foldable blank attached to said center panel along said end edges and folded at said edges to a position substantially perpendicular to said center panel so that said folded end panels are adjacent said folded side panels at said corners of said center panel; and a tension member connecting said side panels to said end panels at each of said corners.

13. The assemblable body board of claim 12, wherein:

each of said side panels and said end panels defines an opening at the ends thereof; and said tension member includes a cable tie configured to fit through said opening in a side panel and an end panel at one of said corners, whereby said cable tie is pulled into tension to connect said side panel to said end panel at said corner.

14. The assemblable body board of claim 13, further comprising:

a side reinforcement beam attached to each of said opposite side panels, said side reinforcement beam defining an opening at its opposite ends thereof and an end reinforcement beam attached to each of said opposite end panels, said end reinforcement beam defining an opening at its opposite ends thereof, wherein said cable tie passes through the openings in said reinforcement beams at said corner.

15. The assemblable body board of claim 14, wherein said side and end reinforcement beams are permanently attached to said blank.

16. The assemblable body board of claim 15, wherein said side and end reinforcement beams are adhered to said blank.

17. The assemblable body board of claim 16, further comprising staples at least temporarily attaching said side and end reinforcement beams to said blank.

18. The assemblable body board of claim 14, wherein said side and end reinforcement beams are formed of a cellulosic material.

19. The assemblable body board of claim 18, wherein said cellulo sic material is a medium density fiberboard.

20. The assemblable body board of clam 14, wherein said side and end reinforcement beams are formed of a light weight wood.

21. The assemblable body board of claim 12, further comprising at least one tension member spanning said center panel and connected to each of said opposite side panels.

22. The assemblable body board of claim 21, wherein said at least one tension member is a cable tie.

23. The blank of claim 12, wherein said side panels include side panel edges at the opposite longitudinal ends thereof, and said end panels include end panel edges at the opposite transverse ends thereof, said side panel edges and end panel edges being complementary to each other when said side panels and said end panels are folded to the substantially perpendicular angle to meet at said corners.

24. The blank of claim 12, wherein said blank is formed of a cellulosic material.

25. The blank of claim 24, wherein the cellulosic material is a fiberboard.

26. The blank of claim 25, wherein the fiberboard is a single wall corrugated fiberboard.

27. The blank of claim 12, further comprising a substantially rectangular support board affixed to said blank within said center panel.

28. The blank of claim 27, wherein said support board is formed of a double-walled corrugated fiberboard.

29. The blank of claim 12, wherein each of said opposite side panels defines a plurality of hand-hold cut-outs sized to receive a human hand for grasping.

30. The blank of claim 29, wherein said opposite side panels define a hand-hold flap within each of said plurality of hand-hold cut-outs.

31. The blank of claim 12, wherein said center panel defines a plurality of strap cut-outs adjacent each of said longitudinal side edges, said strap cut-outs sized to receive a patient restraint therethrough.

32. An assemblable body board comprising:

a blank formed of a sheet of a foldable material, said blank including;

a generally rectangular center panel sized to support a patient thereon and having longitudinal side edges, transverse end edges and corners therebetween;

opposite side panels attached to said center panel along said side edges and foldable at said side edges to a position substantially perpendicular to said center panel, each of said side panels including;

an outer side panel contiguous with a corresponding side edge; and a side reinforcement panel attached to said outer side panel along a longitudinally extending apex bend line and having a free edge, said side reinforcement panel foldable along said apex bend line so that said side reinforcement panel is inboard of said outer side panel and said free edge is adjacent said center panel; and opposite end panels attached to said cehter panel along said end edges and foldable at said edges to a position substantially perpendicular to said center panel; and a pair of side reinforcement beams that are substantially more rigid than said blank, a corresponding one of said pair of beams affixed to each of said opposite side panels to be disposed between said outer side panel and said side reinforcement panel when said side reinforcement panel is folded.

33. The assemblable body board of claim 32, wherein each of said side reinforcement beams is adhered to said side reinforcement panel of each of said opposite side panels.

34. The assemblable body board of claim 32, further comprising a pair of end reinforcement beams that are substantially more rigid than said blank, a corresponding one of said end reinforcement beams affixed to each of said end panels to be disposed between said outer end panel and said end reinforcement panel when said end reinforcement panel is folded.

35. The assemblable body board of claim 34, wherein each of said side and end reinforcement beams defines an opening at the ends thereof, and said body board further comprises a plurality of cable ties, at least one of said cable ties passing through said opening in a side reinforcement beam and said opening in an end reinforcement beam, said at least one cable tie initially loosely spanning between said side and end reinforcement beams across a corner of the body board so that said side and end panels may lie generally flat, and each of said plurality of cable ties configured to be pulled into tension to connect said side and end reinforcement beams at the corners.

36. A blank of a foldable sheet material for forming a body board suitable for carrying a patient, the blank comprising:

an elongated center panel sized to support a patient thereon;

opposite side panels attached to said center panel along corresponding longitudinal joints, each of said side panels including;

an outer side panel contiguous with a corresponding longitudinal joint; and a side reinforcement panel attached to said outer side panel along a longitudinally extending apex bend line and having a free edge, wherein the opposite side panels are foldable along said longitudinal joints and apex bend lines so that said outer side panels are disposed at a substantially perpendicular angle relative to said center panel, and said side reinforcement panels are inboard of said outer side panels with said free edges adjacent said center panel; and wherein a width of each unfolded side panel measured from the longitudinal joint to the free edge is less than one-half of a width of the center panel.

37. The blank of claim 36, wherein each of said opposite side panels defines a plurality of hand-hold cut-outs sized to receive a human hand for grasping.

38. The blank of claim 37, wherein said plurality of hand-hold cut-outs straddle said apex bend line, whereby when said side panels are folded at said apex bend line said cut-outs form an opening along said apex bend line.

39. The blank of claim 37, wherein said opposite side panels defines a hand-hold flap within each of said plurality of hand-hold cut-outs.

40. The blank of claim 36, wherein said center panel defines a plurality of strap cut-outs adjacent each of said longitudinal joints, said strap cut-outs sized to receive a patient restraint therethrough.

41. The blank of claim 36, wherein said blank is formed of a fiberboard.

42. The blank of claim 41, wherein the fiberboard is a single wall corrugated fiberboard.

43. The blank of claim 36, further comprising a substantially rectangular support board affixed to said blank within said center panel.

44. The blank of claim 43, wherein said support board is formed of a double-walled corrugated fiberboard.

45. An assemblable body board formed from a foldable blank comprising:

a generally rectangular center panel of the foldable blank sized to support a patient thereon and having longitudinal side edges, transverse end edges and corners therebetween;

opposite side panels of the foldable blank attached to said center panel along said side edges and folded at said side edges to a position substantially perpendicular to said center panel; and at least one tension member spanning said center panel and connecting said opposite side panels.

46. The assemblable body board of claim 45, wherein:

each of said side panels an opening for receiving each of said at least one tension member; and said tension member includes a cable tie configured to fit through said opening, whereby said cable tie is pulled into tension when said side panels are in the perpendicular orientation.

47. The assemblable body board of claim 45, further comprising:

a side reinforcement beam attached to each of said opposite side panels, wherein said tension member is arranged to engage said side reinforcement beam in each of said side panels.

48. The assemblable body board of claim 47, wherein said tension member is wrapped around a portion of each side reinforcement beam.

49. The assemblable body board of claim 47, wherein said side reinforcement beams are permanently attached to said blank.

* * * * *